US012195897B2

(12) United States Patent
Luo et al.

(10) Patent No.: US 12,195,897 B2
(45) Date of Patent: Jan. 14, 2025

(54) ANTIBACTERIAL BREATHABLE FABRIC AND PREPARATION METHOD THEREOF

(71) Applicant: DAWNSENS NEW MATERIALS (XIAMEN) CO., LTD., Xiamen (CN)

(72) Inventors: Zhangsheng Luo, Xiamen (CN); Junyong Xu, Xiamen (CN)

(73) Assignee: Dawnsens New Materials (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 18/650,688

(22) Filed: Apr. 30, 2024

(65) Prior Publication Data

US 2024/0279855 A1 Aug. 22, 2024

Related U.S. Application Data

(63) Continuation of application No. PCT/CN2023/083371, filed on Mar. 23, 2023.

(30) Foreign Application Priority Data

Jul. 15, 2022 (CN) ..... 202210837465.7

(51) Int. Cl.
*D01D 5/11* (2006.01)
*D01D 10/00* (2006.01)
(Continued)

(52) U.S. Cl.
CPC ..... *D04H 1/558* (2013.01); *D02J 13/005* (2013.01); *D04H 1/4291* (2013.01); *D04H 1/724* (2013.01);
(Continued)

(58) Field of Classification Search
CPC ..... D01D 5/11; D01D 10/00; D01D 10/02; D02J 13/005; D04H 1/49; D04H 1/492; D04H 1/724; D10B 2401/13
(Continued)

(56) References Cited

U.S. PATENT DOCUMENTS 6,592,960 B1 7/2003 Suzuki et al.
2006/0160453 A1 7/2006 Suh
(Continued)

FOREIGN PATENT DOCUMENTS

CN 1275647 A 12/2000
CN 101040077 A 9/2007
(Continued)

OTHER PUBLICATIONS

Notification to Grant Patent for China Application No. 202210837465.7, mailed Aug. 28, 2023.
(Continued)

*Primary Examiner* — Leo B Tentoni
(74) *Attorney, Agent, or Firm* — Pilloff Passino & Cosenza LLP; Rachel K. Pilloff; Sean A. Passino

(57) ABSTRACT

The disclosure relates to the technical field of nonwoven fabric manufacturing, in particular to a novel antibacterial breathable fabric and a preparation method thereof. The preparation method includes following steps: S1, surface hot rolling treatment: performing the surface hot rolling treatment on a fiber mesh layer, where a lower surface of the fiber mesh layer is supported by a flexible belt, and a hot rolling member contacts and hot rolls an upper surface of the fiber mesh layer, so as to prepare the fiber mesh layer with fibers on the upper surface thermally bonded and fibers on the lower surface fluffy; and S2, spunlace processing treatment: performing the spunlace processing treatment on the lower surface of the fiber mesh layer prepared in the S1; and the flexible belt is made of a high-temperature resistant flexible material.

3 Claims, 8 Drawing Sheets

(51) Int. Cl.

| | |
|---|---|
| ***D01D 10/02*** | (2006.01) |
| ***D02J 13/00*** | (2006.01) |
| ***D04H 1/4291*** | (2012.01) |
| ***D04H 1/49*** | (2012.01) |
| ***D04H 1/558*** | (2012.01) |
| ***D04H 1/724*** | (2012.01) |

(52) U.S. Cl.
CPC .... *D10B 2321/021* (2013.01); *D10B 2401/02* (2013.01); *D10B 2401/063* (2013.01); *D10B 2401/13* (2013.01); *D10B 2403/0111* (2013.01); *D10B 2501/04* (2013.01)

(58) Field of Classification Search
USPC ..... 264/13, 103, 205, 210.1, 210.2, 211.18, 264/234; 28/104
See application file for complete search history.

(56) References Cited

U.S. PATENT DOCUMENTS

| | | | |
|---|---|---|---|
| 2008/0318487 | A1 | 12/2008 | Pedoja |
| 2013/0337714 | A1 | 12/2013 | Shah et al. |
| 2023/0074695 | A1 | 3/2023 | Trinkaus et al. |

FOREIGN PATENT DOCUMENTS

| | | | | | |
|---|---|---|---|---|---|
| CN | 101137503 | A | | 3/2008 | |
| CN | 102493125 | A | | 6/2012 | |
| CN | 104520487 | A | | 4/2015 | |
| CN | 105970657 | A | | 9/2016 | |
| CN | 107475894 | A | | 12/2017 | |
| CN | 108708071 | A | | 10/2018 | |
| CN | 110528172 | A | | 12/2019 | |
| CN | 110528216 | A | | 12/2019 | |
| CN | 115074917 | A | | 9/2022 | |
| CN | 115161877 | A | * | 10/2022 | ..... D04H 1/492 |
| CN | 115897055 | A | | 4/2023 | |
| DK | 166330 | B | | 4/1993 | |
| EP | 3118361 | A1 | | 1/2017 | |
| JP | 2022102131 | A | | 7/2022 | |

OTHER PUBLICATIONS

First Search Report for China Application No. 202210837465.7, dated Aug. 21, 2023.
International Search Report and Written Opinion for PCT/CN2023/083371, mailed May 29, 2023.

* cited by examiner

ANTIBACTERIAL BREATHABLE FABRIC AND PREPARATION METHOD THEREOF

CROSS-REFERENCE TO RELATED APPLICATIONS

This disclosure is a continuation of PCT/CN2023/083371, filed on Mar. 23, 2023 and claims priority of Chinese Patent Application No. 202210837465.7, filed on Jul. 15, 2022, the contents of which are hereby incorporated by reference.

TECHNICAL FIELD

The disclosure relates to the technical field of nonwoven fabric manufacturing, in particular to a novel antibacterial breathable fabric and a preparation method thereof.

BACKGROUND

Flash evaporation polyethylene nonwovens have excellent strength, tear resistance, puncture resistance and a microbial barrier performance, and are best choices for medical protective clothing fabrics.

However, existing reinforcement methods of flash evaporation nonwovens generally adopt hot pressing and hot rolling methods, and fabrics made from these methods are hard and stiff, which are not suitable for making protective clothing directly. Generally, a mechanical softening process is needed later before the fabrics may be used as protective clothing fabrics. However, this treatment is not only complicated and tedious, but also the mechanical softening process will damage fibers in the fabrics, which will eventually affect mechanical strength of the fabrics and reduce service performances of the fabrics.

For example, in the China invention patent application Softening Treatment System And Treatment Process Of Flash Evaporation High-Density Polyethylene Paper with a publication number of CN110528216A and a publication date of Dec. 3, 2019, a softening treatment system of flash evaporation high-density polyethylene paper is disclosed, including mechanical structures such as a button beater with a driving device, a crumpling device for manufacturing transverse wrinkles, and a stretching device for eliminating wrinkles and elongation. In this scheme, flash evaporation high-density polyethylene paper needs to be manufactured first, and then a cloth may be softened by a mechanical force, which may not be formed once. Meanwhile, mechanical force softening will lead to a change of a size of the cloth, reducing mechanical strength of the cloth and ultimately affecting a service life of the cloth.

In addition, the China invention patent application Composite Breathable Sheet with a publication number of CN101137503A and a publication date of Dec. 3, 2019 discloses a moisture-permeable composite sheet with a multi-layer material structure, in which the absorbent fiber nonwoven layer is spunlaced, and it is mentioned that a preparation method is as follows: a non-porous liquid impermeable moisture-permeable film layer is formed on one side of an absorbent nonwoven layer by extrusion coating, and then an adhesive layer of a protective nonwoven layer is laminated onto an opposite side of the film and the absorbent nonwoven layer. The adhesive layer is located between the protective nonwoven layer and the film layer. From a manufacturing process, it may be inferred that each layer of the multi-layer material is made by a same single process, multiple processes are used to produce materials for different purposes, and then multi-layer composite is performed. There are many processing steps, making it impossible to achieve one-time molding.

SUMMARY

In order to solve problems of the prior art mentioned in the above background technology, firstly, fabrics made of existing flash evaporation nonwovens by hot pressing and hot rolling is stiff in texture, so a mechanical softening process is needed later before the fabrics may be used as protective clothing fabrics. A preparation method has complicated process steps and affects mechanical strength of the fabrics. Secondly, to prepare a finished fabric with good strength, water resistance, an antibacterial property and wearing comfort, there is a need to use various materials from different processes to composite or bond to form a multi-layer composite structure to obtain a required performance. This preparation method has many processing procedures, making it impossible to achieve one-time molding. The disclosure provides a preparation method of a novel antibacterial breathable fabric, including following steps:

S1, surface hot rolling treatment: performing the surface hot rolling treatment on a fiber mesh layer, where, a lower surface of the fiber mesh layer is supported by a flexible belt, and a hot rolling member contacts and hot rolls an upper surface of the fiber mesh layer, so as to prepare the fiber mesh layer with fibers on the upper surface thermally bonded and fibers on the lower surface fluffy; and S2, spunlace processing treatment: performing the spunlace processing treatment on the lower surface of the fiber mesh layer prepared in the S1; the flexible belt is made of a high-temperature resistant flexible material.

In one embodiment, the fiber mesh layer is subjected to cold pressing treatment before the surface hot rolling treatment.

In one embodiment, the method further includes a drying step; in the drying step, a nonwoven fabric treated by the S2 is dried to remove moisture on the nonwoven fabric, thus obtaining the novel antibacterial breathable fabric.

In one embodiment, in the drying step, the drying temperature is less than a melting point of the fiber mesh layer.

In one embodiment, the flexible belt is made of a high-temperature resistant blanket.

The disclosure also adopts a novel antibacterial breathable fabric, including a first side and a second side, where the first side is an antibacterial surface and the second side is a spunlaced surface layer.

A surface hot rolling treatment is carried out on the upper surface of the fiber mesh layer to form an antibacterial surface on the upper surface. In a surface hot rolling process, the lower surface of the fiber mesh layer is supported by the flexible belt, and the hot rolling member contacts and hot rolls the upper surface.

The lower surface of the fiber mesh layer after the surface hot rolling treatment is treated by spunlace to form a spunlaced surface layer on the lower surface.

In one embodiment, its weight is greater than or equal to 30 gram (g) and less than or equal to 90 g, and its thickness is greater than or equal to 0.1 millimeter (mm) and less than or equal to 0.5 mm.

In one embodiment, its air permeability is greater than or equal to 5 mm/second (s) and less than or equal to 50 mm/s, and water permeability of the first side is greater than or equal to 5 kilopascal (kPa) and less than or equal to 20 kPa.

In one embodiment, its transverse and longitudinal breaking strengths are greater than 150 Newton (N)/5 centimeters (cm), a tearing strength is greater than 8 N, a peeling strength is greater than 3 N, and a drape coefficient is less than 50%.

In one embodiment, its moisture permeability is more than 2500 g/(square meter·day) ($m^2$·d), and synthetic blood penetration resistance of the first side is more than grade 2.

Based on the above, compared with the prior art, the preparation method of the novel antibacterial breathable fabric provided by the disclosure has following beneficial effects.

Through the preparation method of the novel antibacterial breathable fabric provided by the disclosure, the antibacterial breathable fabric may be processed and formed at one time, a subsequent softening treatment is not needed in a preparation process, and the finished fabric does not need to be compounded or bonded by materials with different processes, so that the finished fabric has two characteristics: waterproof and antibacterial properties and good wearing comfort. Meanwhile, good mechanical properties are maintained to prolong a service life and meet use requirements of the finished fabric.

Other features and benefits of this disclosure will be set forth in the subsequent specification, and in part will be obvious from the specification, or may be learned by practice of this disclosure. Objectives and other beneficial effects of this disclosure may be realized and obtained by the structures particularly pointed out in the specification, claims and drawings.

BRIEF DESCRIPTION OF THE DRAWINGS

In order to more clearly explain embodiments of the disclosure or technical schemes in the prior art, drawings needed to be used in the description of the embodiments or the prior art will be briefly introduced below. Obviously, the drawings in the following description are some embodiments of the disclosure, and other drawings may be obtained according to these drawings without creative work for ordinary people in the field. In the following description, unless otherwise specified, positional relationships described in the attached drawings are based on directions of components in the drawings.

DETAILED DESCRIPTION OF THE EMBODIMENTS

In order to make a purpose, technical schemes and advantages of embodiments of the disclosure clearer, the technical schemes in the embodiments of the disclosure will be described clearly and completely with the attached drawings. Obviously, the described embodiments are a part of the embodiments of the disclosure, but not all embodiments. Technical features designed in different embodiments of the disclosure described below may be combined with each other as long as they do not conflict with each other. Based on the embodiments in this disclosure, all other embodiments obtained by ordinary technicians in this field without creative work belong to a protection scope of this disclosure.

In the description of this disclosure, it should be noted that all terms (including technical terms and scientific terms) used in this disclosure have same meanings as those commonly understood by ordinary technicians in the field to which this disclosure belongs, and may not be understood as limitations of this disclosure. It should be further understood that the terms used in this disclosure should be understood as having meanings consistent with those of these terms in the context of this specification and related fields, and should not be understood in an idealized or overly formal sense, unless explicitly defined in this disclosure.

Figure 1:
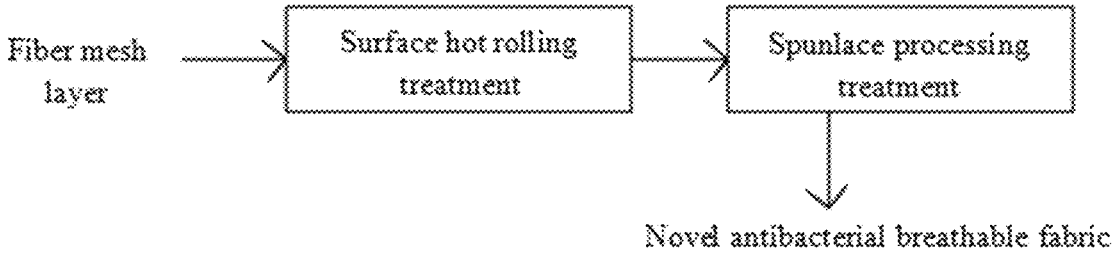
FIG. 1 is a process flow chart of a preparation method of a novel antibacterial breathable fabric provided by the disclosure.
Figure 2:
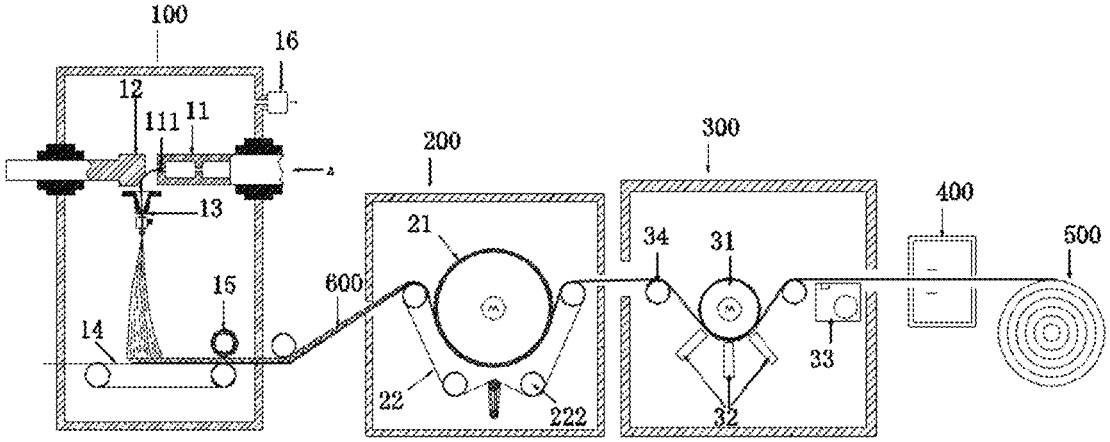
FIG. 2 is a schematic structural diagram of a preferred embodiment of a production device of an antibacterial breathable fabric provided by the disclosure.
Figure 3:
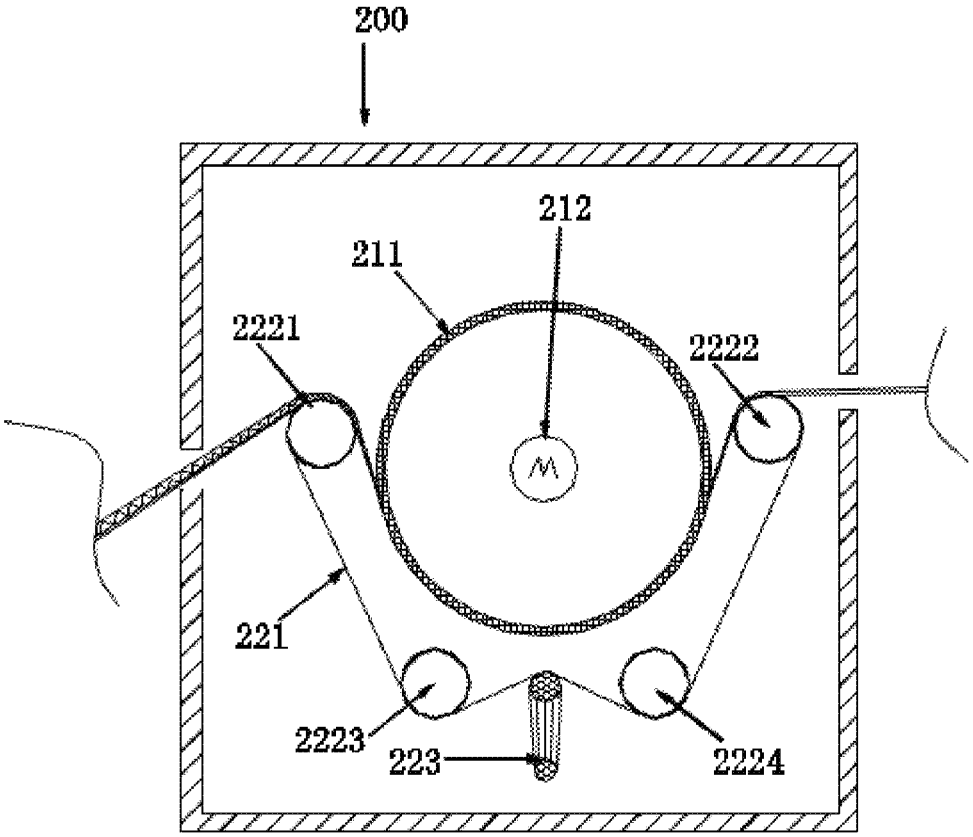
FIG. 3 is a schematic structural diagram of a surface hot rolling unit in the preferred embodiment of the production device of the antibacterial breathable fabric provided by the disclosure.
Figure 4:
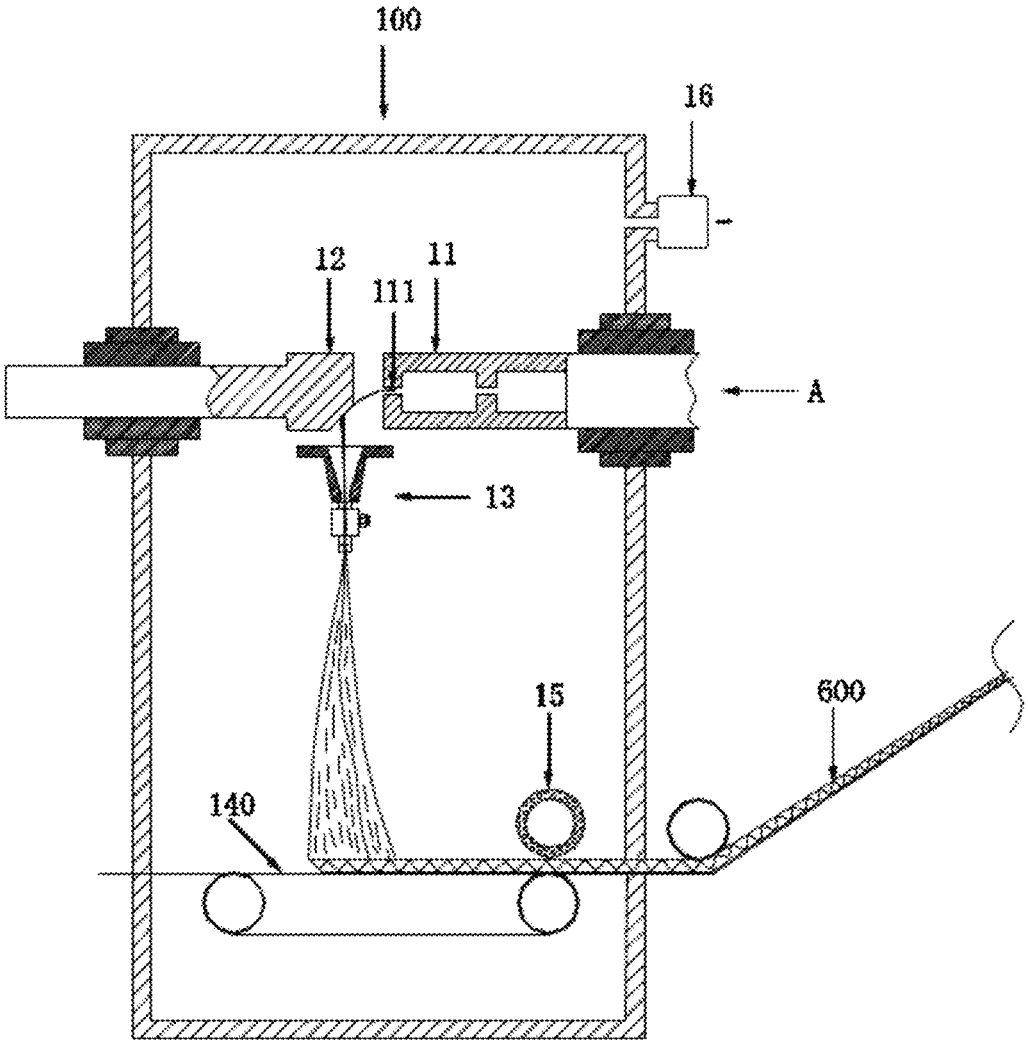
FIG. 4 is a schematic structural diagram of a flash spinning unit in the preferred embodiment of the production device of the antibacterial breathable fabric provided by the disclosure.
Figure 5:
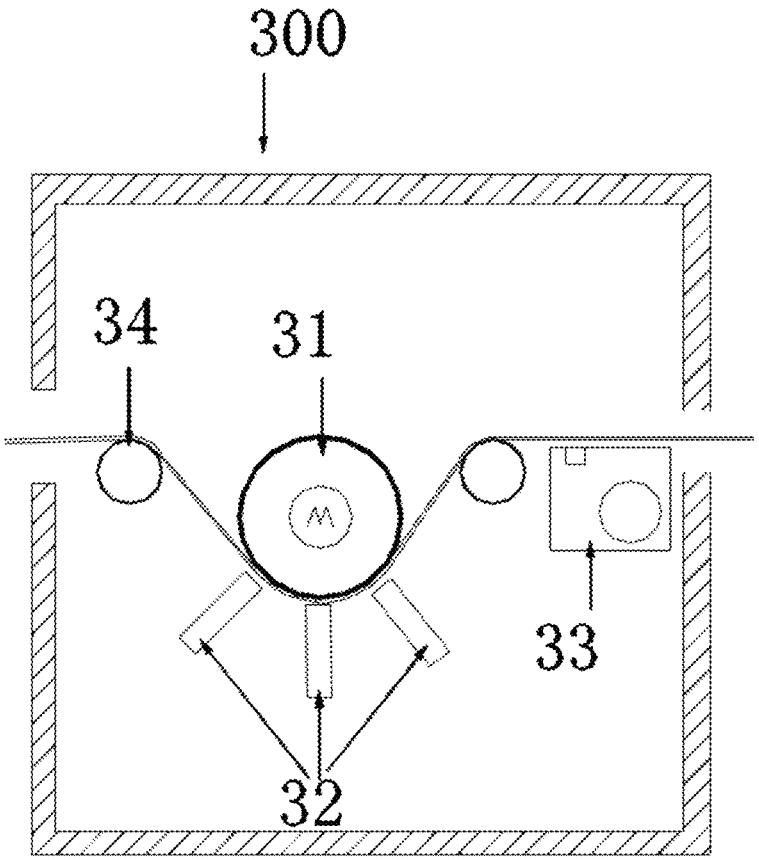
FIG. 5 is a schematic structural diagram of a spunlaced consolidation unit in the preferred embodiment of the production device of the antibacterial breathable fabric provided by the disclosure.

FIG. 1 is a process flow chart of a preparation method of a novel antibacterial breathable fabric provided by the disclosure. FIGS. 2-5 are schematic diagrams to assist in explaining preferred schemes of a production device used to realize the preparation method of the novel antibacterial breathable fabric 700, where the production device of the novel antibacterial breathable fabric 700 includes a flash spinning unit 100, a surface hot rolling unit 200, a spunlaced consolidation unit 300, a drying unit 400 and a winding unit 500 which are connected in sequence.

With reference to FIGS. 1-5, a preferred embodiment of the preparation method of the novel antibacterial breathable fabric 700 provided by the disclosure is as follows.

The method includes the following steps:

S1, surface hot rolling treatment: the fiber mesh layer 600 is subjected to the surface hot rolling treatment, where a lower surface of the fiber mesh layer 600 is supported by a flexible belt 221, and a hot rolling member 211 contacts and hot rolls an upper surface of the fiber mesh layer 600, so as to produce the fiber mesh layer 600 with fibers on the upper surface thermally bonded and fibers on the lower surface fluffy; and S2, spunlace processing treatment: performing the spunlace processing treatment on the lower surface of the fiber mesh layer 600 prepared in the S1. The flexible belt 221 is made of a high-temperature resistant flexible material.

Specifically, in the preparation process, the upper surface of the fiber mesh layer 600 is in contact with the hot rolling member 211 for the surface hot rolling treatment, and the fibers on the upper surface of the fiber mesh layer 600 are heated, fused, bonded and reinforced to form a dense fiber layer, which has excellent waterproof and antibacterial properties. The lower surface of the fiber mesh layer 600 is in contact with the flexible belt 221, and is supported by the surface hot rolling treatment of the flexible belt 221. Because the flexible belt 221 is made of the high-temperature resistant flexible material, the flexible belt 221 itself is soft and has a low temperature and does not melt-bond, so that the lower surface of the fiber mesh layer 600 does not melt-bond during the surface hot rolling treatment, and the fibers still remain fluffy.

The hot rolled fiber mesh layer 600 is subsequently subjected to spunlace processing treatment, and high-pressure water needles formed by spunlace heads 32 act on the lower surface (i.e., a fluffy side of the fibers) of the fiber mesh layer 600, the fluffy fibers are entangled with each other by an action of the high-pressure water needles, so that the fiber mesh layer 600 forms a dense nonwoven fabric with a certain thickness.

Specifically, the preparation method of the novel antibacterial breathable fabric 700 provided by this disclosure includes at least following design principles and inventive concepts.

The existing spunlace processing treatment belongs to flexible entanglement, which does not affect original characteristics of the fibers and does not damage the fibers. Nonwoven fabrics processed by this method may not only ensure their mechanical properties, but also have a softer appearance and better wearing comfort than other nonwoven materials. However, the spunlace method has a requirement for a processed material, which requires that fibers on a surface of the material should be crosslinked before the spunlace processing, and the fibers should be kept in a relatively fluffy state, so that the material will not fall apart during the spunlace processing. Meanwhile, the fibers may be entangled under an action of water needles to ensure a spunlace effect on a surface of a cloth.

Key points of the disclosure are as follows.

Two surfaces of a finished fabric prepared by the disclosure need to have two characteristics. One surface has characteristics of flash polyethylene paper, with a smooth surface and a dense thermal bonding fiber layer, so the surface has good waterproof and antibacterial properties. An other surface has characteristics of a spunlaced nonwoven. The surface of the finished fabric has characteristics similar to those of traditional textiles, and has good skin-friendliness. At the same time, the material has good overall softness, good wearing comfort and good mechanical properties.

In order to realize this feature, this disclosure innovatively introduces a spunlace technology into a processing technology of flash evaporation nonwovens. In order to make a fabric have surface features of the spunlaced nonwovens, fibers on the fabric should be kept fluffy as much as possible before spunlaced processing.

Based on this, the disclosure found that a key point should be specially controlled in the preparation method, that is, when the surface of the fiber mesh layer 600 is reinforced by thermal bonding, it is necessary to ensure that surface fibers of a surface of the material contacting the hot rolling member 211 are fully heated and thermally bonded and consolidated, and at the same time, it is necessary to ensure that surface fibers of an other surface that are not in contact with the hot rolling member 211 remain fluffy, so that the surface fibers of the fluffy side may be fully entangled during spunlace processing treatment, so as to make a prepared material have good air permeability and soft wearing comfort, and waterproof and antibacterial properties of the thermally bonded side may be maintained. Different from traditional hot rolling processes, a surface that is not in contact with the hot rolling member 211 in the surface hot rolling treatment in this disclosure is supported by the soft and high-temperature resistant flexible belt 221, so that the fibers on this surface remain fluffy, so that the fibers may be combined with spunlace processing treatment steps to obtain the finished fabric with required properties.

To sum up, the following may be seen.

In this disclosure, the spunlace technology is innovatively applied to a production process of flash evaporation nonwovens. At the same time, in order to ensure the spunlace effect, a surface hot rolling technology is innovatively applied: a traditional stainless steel roller or a rubber roller is replaced by the soft and high-temperature resistant flexible belt 221, and a surface of the fiber mesh layer contacting with the hot roller is heated, and the heated fibers are bonded together to form a compact waterproof and antibacterial layer. The fibers on the other surface are not in contact with the hot rolling member 211, and are in contact with the soft and high-temperature resistant flexible belt 221, so the surface fibers may still be kept in a fluffy state, which avoids the densification of the fibers on both sides caused by traditional hot rolling methods, and is beneficial to entanglement with water needles in subsequent spunlace processing treatment.

The surface hot rolling technology and spunlace processing treatment are combined to prepare required materials at one time, without traditional mechanical softening, and the finished fabric does not need to be compounded or bonded by materials with different processes. The fabric prepared by the disclosure has good air permeability and soft wearing comfort, and maintains the waterproof and antibacterial properties of the thermally bonded side, while still maintaining good mechanical properties.

Optionally, in the surface hot rolling treatment, a hot rolling temperature (that is, a temperature of the hot rolling member 211) is (100-200)° C., and a tension of the flexible belt 221 is controlled at 0.5-6.0 Megapascal (MPa). In spunlace processing treatment, a spunlace pressure is (20-250) bar. Through a proper hot rolling temperature and a proper pressure, upper surface fibers of the fiber mesh layer 600 contacting the surface of the hot rolling member 211 may be heated, fused, bonded and reinforced to form a dense fiber layer.

Optionally, the method also includes a preparation step of the fiber mesh layer 600. In the preparation step of the fiber mesh layer 600, high polymer is used as a raw material to prepare a spinning solution, and the spinning solution is formed into fiber mesh layer 600 by a flash spinning method.

Optionally, the fiber mesh layer 600 is subjected to cold pressing treatment before surface hot rolling treatment. After the fiber mesh layer 600 is prepared, before the surface hot rolling treatment, the fiber mesh layer 600 is subjected to the cold pressing treatment to slightly compress the fiber mesh layer 600, so that the fiber mesh layer 600 has a certain tensile force, which is convenient for the fiber mesh layer 600 to be transported to the next process. In an embodiment, the fiber mesh layer is cold pressed with a cold pressing member 15, and the cold pressing member 15 is a stainless steel roll with a hollow center. A lighter weight of a press roller ensures that the fiber mesh layer 600 will not be pressed too tightly, which is beneficial to formation of a clear upper surface with fused fibers and a lower surface with fluffy fibers without bonding after the surface hot rolling treatment.

Optionally, the method also includes a drying step. In the drying step, the nonwoven fabric treated by the S2 is dried to remove moisture on the nonwoven fabric, thus obtaining the novel antibacterial breathable fabric 700. In an embodiment, in the drying step, the drying temperature is less than a melting point of the fiber mesh layer 600 (that is, a melting point of the polymer in the spinning solution). The spunlaced nonwoven fabric is dried to completely remove the moisture on a surface of the nonwoven fabric. At the same time, because a polymer raw material belongs to thermoplastic material, the fibers will soften after heating to a certain temperature, and after cooling, spunlaced entangled fibers will firmly hold together, which is conducive to improving a performance of the finished fabric, and a drying temperature does not exceed the melting point of the polymer, so that the fibers will not melt and the fabric will not harden, so a dried nonwoven fabric may still maintain soft characteristics of a spunlaced nonwoven fabric.

Optionally, the flexible belt 221 is made of a high-temperature resistant blanket. The flexible belt 221 is made of a high-temperature resistant blanket material. The high-temperature resistant blanket material is not only easy to obtain raw materials, but also has soft texture and high-temperature resistance, so the material may meet use requirements. It should be noted that according to the above design concept, the flexible belt 221 may also be made of other high-temperature resistant flexible materials, which have certain flexibility, soft texture and high temperature resistance. A material with a temperature resistance above 240° C. is preferred.

The disclosure provides a preferred embodiment of a production device used to realize the preparation method of the novel antibacterial breathable fabric 700 as shown in FIGS. 2-5, as follows.

The production device of the novel antibacterial breathable fabric 700 includes a flash spinning unit 100, a surface hot rolling unit 200, a spunlaced consolidation unit 300 and a drying unit 400 which are connected in sequence.

Among them, the flash spinning unit 100 is used to prepare the fiber mesh layer 600. The surface hot rolling unit 200 includes a conveyor belt member 22 and a rotary heating member 21. The conveyor belt member 22 includes a flexible belt 221 and at least two support members 222. The support members 222 are rotatably supported on an inner surface of the flexible belt 221. An outer surface of the flexible belt 221 is in contact with an outer periphery of the rotary heating member 21, and the rotary heating member 21 rotates to drive the flexible belt 221 to move around an outer periphery of the support member 222, so that after the fiber mesh layer 600 is introduced into the outer surface of the flexible belt 221, a lower surface of the fiber mesh layer 600 is in contact with the flexible belt 221, and an upper surface of the fiber mesh layer 600 is brought into the outer periphery of the rotary heating member 21 for surface hot rolling treatment. The spunlaced consolidation unit 300 is used to spunlace the lower surface of the fiber mesh layer 600 after the surface hot rolling treatment to obtain a spunlaced nonwoven fabric. The drying unit 400 is used for drying the spunlaced nonwoven fabric to obtain antibacterial breathable fabric.

The flash spinning unit 100 is as follows.

Optionally, components of the flash spinning unit 100 include a spray head 11, a rotating wire splitter plate 12, an air amplifier 13, and a moving mesh curtain 14. It should be noted that the spray head 11, the rotating wire splitter plate 12, the air amplifier 13 and the moving mesh curtain 14 are all existing components of the flash spinning unit 100, and their structures and connection relations are also in the prior art, so they will not be described here again.

Optionally, the flash spinning unit 100 includes a cold pressing member 15 disposed above the moving mesh curtain 14. Optionally, the cold pressing member 15 adopts a cold pressing roller, which is a stainless steel roller with a hollow center. A cold pressing member 15 is provided for cold pressing the fiber mesh layer 600 on the moving mesh curtain 14.

Optionally, the flash spinning unit 100 is further provided with a first vacuum suction device 16 for extracting a solvent evaporated into a gaseous state. The solvent is recovered by the first vacuum suction device 16, and recovered gas may be recycled after being condensed to form a liquid solvent.

It should be noted that, according to the design concept of this disclosure, this disclosure may also adopt other existing flash spinning units 100 for preparing the fiber mesh layer 600, including but not limited to a scheme of the flash spinning unit 100 provided by the above preferred scheme.

For the surface hot rolling unit 200 is as follows.

Optionally, the flexible belt 221 has a closed annular structure, and the flexible belt 221 is driven to rotate around the support member 222 by rotation of the rotary heating member 21. In an embodiment, the support member 222 adopts a guide support roller. In use, the fiber mesh layer 600 is introduced into the flexible belt 221 through the support member 222 (guide support roller) and moves with the flexible belt 221. Through cooperation of the support member 222 and the annular flexible belt 221, not only a usage of the flexible belt 221 is saved, but also rotation of the flexible belt 221 is more convenient.

Optionally, the conveyor belt member 22 further includes a tension adjuster 223 for adjusting tension of the flexible belt 221. The tension of the flexible belt 221 may be adjusted by the tension adjuster 223 to adjust an interaction force (i.e., hot rolling pressure) between an outer surface of the flexible belt 221 and the outer periphery of the rotary heating member 21.

Optionally, the conveyor belt member 22 includes a first support member 2221, a second support member 2222, a third support member 2223 and a fourth support member 2224. The first support member 2221 and the second support member 2222 are respectively arranged at both sides of the rotary heating member 21, and the third support member 2223 and the fourth support member 2224 are arranged below the rotary heating member 21. With this arrangement, a working area of the rotary heating member 21 for melt bonding the upper surface of the fiber mesh layer 600 is increased, and production efficiency is improved. In an embodiment, the tension adjuster 223 is arranged outside the flexible belt 221 and between the third support member 2223 and the fourth support member 2224, so that the flexible belt 221 is distributed in a W-shape. With this arrangement, it is convenient for the tension adjuster 223 to cooperate with the support member 222 to adjust tension of the flexible belt 221.

Optionally, the rotary heating member 21 includes a hot rolling member 211 (hot roller) and a transmission device 212 for driving the hot rolling member 211 to rotate.

For the spunlaced consolidation unit 300 is as follows.

Optionally, components of the spunlaced consolidation unit 300 include a drum 31, spunlace heads 32, a second vacuum suction device 33, and a guide roller 34. It should be noted that the drum 31, the spunlace heads 32, the second vacuum suction device 33 and the guide roller 34 are all existing components of the spunlaced consolidation unit 300, and their structures and connection relationships are also in the prior art, so they will not be described here again. According to the design concept of the disclosure, the disclosure may also adopt the existing spunlaced consolidation unit 300 with other configurations, including but not limited to the scheme of spunlaced consolidation unit 300 provided by the above preferred scheme.

As for the drying unit 400, it should be noted that the drying unit 400 may choose existing drying equipment, such as the drum 31 dryer or a clamp dryer, which will not be described in detail in this disclosure.

For the winding unit 500 is as follows.

Optionally, the production device further includes a winding unit 500 for winding a dried nonwoven fabric (i.e., antibacterial breathable fabric). It should be noted that the winding unit 500 may be an existing winding machine, which is not specifically described in this disclosure.

Combining the preparation method of the novel antibacterial breathable fabric 700 and the production device shown in FIGS. 2-5, a specific working process of realizing the preparation method by using the preferred embodiment of the production device of the novel antibacterial breathable fabric 700 is as follows.

The polymer is added into a high-pressure reaction kettle through a solution metering device and a matched solvent through a solvent metering device according to a preset proportion, and the high-pressure reaction kettle is heated and boosted to a preset reaction temperature and a preset pressure state, and the polymer and the solvent are fully dissolved to form a uniform solution (namely a spinning solution) under a stirring action of a stirrer.

The uniform solution is delivered to the spray head 11 through a high-pressure delivery pipeline, and sprayed out through a spinneret hole of the spray head 11. The solvent in the solution quickly evaporates from a high-temperature and high-pressure liquid into a gas state, and the polymer is quickly cooled after being absorbed by heat, and is quickly stretched by flashed solvent gas to form a fiber bundle containing many superfine fibers. The fiber bundle is refracted and diverged by the rotating wire splitter plate 12 and amplified by the air amplifier 13 to form a fiber mesh with a mesh structure. The continuously formed fiber mesh is laid on the moving mesh curtain 14, and an advancing direction of the moving mesh curtain 14 is perpendicular to a falling direction of the fiber mesh, so that the fiber mesh forms a continuous fiber mesh layer 600 with a certain weight and a certain width on the moving mesh curtain 14, and the fiber mesh layer 600 is conveyed and output by the moving mesh curtain 14.

Before entering the surface hot rolling unit 200, the cold pressing member 15 arranged above the moving mesh curtain 14 is used for cold pressing the fiber mesh layer 600 on the moving mesh curtain 14. The solvent gas is recovered by the first vacuum suction device 16 arranged above, and condensed to form a liquid solvent for recycling.

After cold pressing, the fiber mesh layer 600 enters the surface hot rolling unit 200, and the fiber mesh layer 600 is introduced into the flexible belt 221 through the support member 222 (the guide support roller). The rotary heating member 21 rotates to drive the flexible belt to move with it, and the lower surface of the fiber mesh layer 600 contacts with the flexible belt 221. With a movement of the flexible belt 221, the upper surface of the fiber mesh layer 600 is brought into the periphery of the rotary heating member 21 for surface hot rolling treatment. The fibers on the upper surface of the fiber mesh layer 600 contacting the surface of the rotary heating member 21 are heated, fused, bonded and reinforced to form a dense fiber layer. The lower surface of the fiber mesh layer 600 is not fused and bonded, and the fibers remain fluffy.

After the fiber mesh layer 600 treated by the surface hot rolling unit 200 enters the spunlaced consolidation unit 300, the upper surface of the fiber mesh layer 600 (i.e., the surface that has been consolidated by hot rolling) sticks to the drum 31, and the high-pressure water needle formed by the spunlace head 32 acts on the lower surface of the fiber mesh layer 600 (i.e., the surface with fluffy fibers). The fluffy fibers are entangled with each other by an action of the high-pressure water needle, and the fiber mesh layer 600 forms a dense nonwoven fabric with a certain thickness. The produced nonwoven fabric is removed with excess moisture on the surface by a second vacuum suction device 33, and then is output by the guide roller 34.

The spunlaced nonwoven fabric enters the drying unit 400 to remove moisture on the surface of the nonwoven fabric. Finally, a dry finished product is wound by the winding unit 500.

The disclosure also provides following embodiments and comparative examples.

In order to show an effect of the nonwoven fabric (i.e., the antibacterial breathable fabric) prepared by the preparation method of the novel antibacterial breathable fabric 700, the following embodiments and the comparative examples are specially set. Advantages of the preparation method of the novel antibacterial breathable fabric 700 provided by the disclosure are reflected through a test and comparison of relevant performance parameters of the prepared product.

Embodiment 1

(1) A fiber mesh layer 600 is formed by a flash spinning method.

Preparation of a spinning solution with a high polymer as a raw material: polyethylene chips with a mass concentration of 15% and a solvent with a mass concentration of 85% (a mixture of 15% difluoromethane (R22) and 85% tetrafluoroethylene dichloride (R114)) are simultaneously added into a high-pressure reaction kettle, and a temperature is raised to 180° C. After heating is completed, nitrogen is introduced to pressurize to 12 MPa. At the same time, the temperature is raised to 230° C. and stirred for 2 hours at a stirring speed of 100 revolutions/minute (r/min). After the temperature is stabilized, a uniform spinning solution has been formed in the high-pressure reaction kettle.

The spinning solution is processed by the preferred embodiments of the production device of the novel antibacterial breathable fabric 700 as shown in FIGS. 2-5, that is, the spinning solution is spun by the flash spinning unit 100 to form a fiber mesh layer 600 of 65 gram (g). Among them, the spinning solution is sprayed from the spray head 11, and a speed of a sprayed air flow is 12,000 meters (m)/min, so that a spinning dope quickly volatilizes, and the polymer cools and solidifies to form a fiber bundle. The fiber bundle settles on the moving mesh curtain 14, and the fibers condense into a net (that is, the fiber mesh layer 600), and a forward speed of the moving mesh curtain 14 is 50 m/min.

(2) The fiber mesh layer 600 is subjected to a cold pressing treatment before a surface hot rolling treatment: the fiber mesh layer 600 is pressed by the cold pressing member 15 (cold pressing roller), and the cold pressing member 15 is a stainless steel roller with a hollow center.

(3) Surface hot rolling treatment.

The prepared fiber mesh layer 600 is introduced into the surface hot rolling unit 200 for the surface hot rolling treatment, so that the fibers on one surface (upper surface) are hot-melted and consolidated to form a dense fiber layer.

Among them, a hot rolling temperature (a temperature of the hot rolling member 211 in the rotary heating member 21) is 140° C., and a rotating speed of the hot rolling member 211 is 52 m/min. The flexible belt 221 adopts a high-temperature resistant blanket. The tension of the flexible belt 211 is controlled at 1.65±0.15 MPa.

(4) Spunlace processing.

The surface hot rolled fiber mesh layer 600 is introduced into the spunlaced consolidation unit 300, and the other surface (i.e., the lower surface) is processed by the spunlaced consolidation unit 300 to form a dense material with different characteristics on both sides, that is, the spunlaced nonwoven fabric is made.

Among them, a spunlace pressure of a pre-wetting spunlace head 32 is 25 bar, a spunlace pressure of a main spunlace head 32 is 80 bar, a spunlace pressure of a surface finishing spunlace head 32 is 52 bar, and a speed of a spunlace drum 31 is 54 m/min.

(5) The spunlaced nonwoven fabric is introduced into the drying unit 400 for drying and dehydration, and low-temperature drying, so as to obtain the antibacterial breathable fabric.

Among them, a drying temperature in the drying unit 400 is 105° C., number of vehicles in the drying unit 400 is 55 m/min, and an exhaust power of the drying unit 400 is set at 95%.

Embodiment 2

(1) A fiber mesh layer 600 is formed by a flash spinning method.

Preparation of a spinning solution with a high polymer as a raw material: polyethylene chips with a mass concentration of 15% and a solvent with a mass concentration of 85% (a mixture of 15% difluoromethane (R22) and 85% tetrafluoroethylene dichloride (R114)) are simultaneously added into a high-pressure reaction kettle, and a temperature is raised to 180° C. After heating is completed, nitrogen is introduced to pressurize to 12 MPa. At the same time, the temperature is raised to 230° C. and stirred for 2 hours at a stirring speed of 100 r/min. After the temperature is stabilized, a uniform spinning solution has been formed in the high-pressure reaction kettle.

The spinning solution is processed by the preferred embodiments of the production device of the novel antibacterial breathable fabric 700 as shown in FIGS. 2-5, that is, the spinning solution is spun by the flash spinning unit 100 to form a fiber mesh layer 600 of 40 g. Among them, the spinning solution is sprayed from the spray head 11, and a speed of a sprayed air flow is 12,000 m/min, so that a spinning dope quickly volatilizes, and the polymer cools and solidifies to form a fiber bundle. The fiber bundle settles on the moving mesh curtain 14, and the fibers condense into a net (that is, the fiber mesh layer 600), and a forward speed of the moving mesh curtain 14 is 80 m/min.

(2) The fiber mesh layer 600 is subjected to a cold pressing treatment before a surface hot rolling treatment: the fiber mesh layer 600 is pressed by the cold pressing member 15 (cold pressing roller), and the cold pressing member 15 is a stainless steel roller with a hollow center.

(3) Surface hot rolling treatment.

The prepared fiber mesh layer 600 is introduced into the surface hot rolling unit 200 for the surface hot rolling treatment, so that the fibers on one surface (upper surface) are hot-melted and consolidated to form a dense fiber layer.

Among them, a hot rolling temperature (a temperature of the hot rolling member 211 in the rotary heating member 21) is 135° C., and a rotating speed of the hot rolling member 211 is 83 m/min. The flexible belt 221 adopts a high-temperature resistant blanket. The tension of the flexible belt 211 is controlled at 1.1±0.1 MPa.

(4) Spunlace processing.

The surface hot rolled fiber mesh layer 600 is introduced into the spunlaced consolidation unit 300, and the other surface (i.e., the lower surface) is processed by the spunlaced consolidation unit 300 to form a dense material with different characteristics on both sides, that is, the spunlaced nonwoven fabric is made.

Among them, a spunlace pressure of a pre-wetting spunlace head 32 is 25 bar, a spunlace pressure of a main spunlace head 32 is 60 bar, a spunlace pressure of a surface finishing spunlace head 32 is 42 bar, and a speed of a spunlace drum 31 is 85 m/min.

(5) The spunlaced nonwoven fabric is introduced into the drying unit 400 for drying and dehydration, and low-temperature drying, so as to obtain the antibacterial breathable fabric.

Among them, a drying temperature in the drying unit 400 is 102° C., number of vehicles in the drying unit 400 is 86 m/min, and an exhaust power of the drying unit 400 is set at 95%.

Embodiment 3

(1) A fiber mesh layer 600 is formed by a flash spinning method.

Preparation of a spinning solution with a high polymer as a raw material: polyethylene chips with a mass concentration of 15% and a solvent with a mass concentration of 85% (a mixture of 15% difluoromethane (R22) and 85% tetrafluoroethylene dichloride (R114)) are simultaneously added into a high-pressure reaction kettle, and a temperature is raised to 180° C. After heating is completed, nitrogen is introduced to pressurize to 12 MPa. At the same time, the temperature is raised to 230° C. and stirred for 2 hours at a stirring speed of 100 r/min. After the temperature is stabilized, a uniform spinning solution has been formed in the high-pressure reaction kettle.

The spinning solution is processed by the preferred embodiments of the production device of the novel antibacterial breathable fabric 700 as shown in FIGS. 2-5, that is, the spinning solution is spun by the flash spinning unit 100 to form a fiber mesh layer 600 of 40 g.

Among them, the spinning solution is sprayed from the spray head 11, and a speed of a sprayed air flow is 12,000 m/min, so that a spinning dope quickly volatilizes, and the polymer cools and solidifies to form a fiber bundle. The fiber bundle settles on the moving mesh curtain 14, and the fibers condense into a net, and a forward speed of the moving mesh curtain 14 is 36 m/min.

(2) The fiber mesh layer 600 is subjected to a cold pressing treatment before a surface hot rolling treatment: the fiber mesh layer 600 is pressed by the cold pressing member 15 (cold pressing roller), and the cold pressing member 15 is a stainless steel roller with a hollow center.

(3) Surface hot rolling treatment.

The prepared fiber mesh layer 600 is introduced into the surface hot rolling unit 200 for the surface hot rolling treatment, so that the fibers on one surface (upper surface) are hot-melted and consolidated to form a dense fiber layer.

Among them, a hot rolling temperature (a temperature of the hot rolling member 211 in the rotary heating member 21) is 145° C., and a rotating speed of the hot rolling member 211 is 37 m/min. The flexible belt 221 adopts a high-temperature resistant blanket. The tension of the flexible belt 211 is controlled at 2.6±0.2 MPa.

(4) Spunlace processing.

The surface hot rolled fiber mesh layer 600 is introduced into the spunlaced consolidation unit 300, and the other surface (i.e., the lower surface) is processed by the spunlaced consolidation unit 300 to form a dense material with different characteristics on both sides, that is, the spunlaced nonwoven fabric is made.

Among them, a spunlace pressure of a pre-wetting spunlace head 32 is 25 bar, a spunlace pressure of a main spunlace head 32 is 100 bar, a spunlace pressure of a surface finishing spunlace head 32 is 55 bar, and a speed of a spunlace drum 31 is 38 m/min.

(5) The spunlaced nonwoven fabric is introduced into the drying unit 400 for drying and dehydration, and low-temperature drying, so as to obtain the antibacterial breathable fabric.

Among them, a drying temperature in the drying unit 400 is 108° C., number of vehicles in the drying unit 400 is 38 m/min, and an exhaust power of the drying unit 400 is set at 95%.

Comparative Example 1

(1) Using the same spinning solution as in Embodiment 1, a 65 g fiber mesh layer 600 is formed by flash spinning. A preparation process and technology of the fiber mesh layer 600 are the same as in Embodiment 1.

(2) The prepared fiber mesh layer 600 is processed by a traditional post-processing technology of flash paper: the fiber mesh layer 600 is directly hot rolled by a stainless steel roller to form a dense and stiff paper-like nonwoven fabric with hot-melt bonding of fibers on both sides.

Among them, a hot rolling process of the stainless steel roller is: a hot rolling temperature is 150° C., a pressurization pressure is 3.0 MPa, and a rotating speed is 55 m/min.

(3) The fiber mesh layer 600 after the hot rolling is treated by a process mentioned in the patent CN110528216A Softening Treatment System And Treatment Process Of Flash Evaporation High-Density Polyethylene Paper to obtain a soft material.

It should be noted that the embodiment adopts the production device of the novel antibacterial breathable fabric 700 shown in the preferred embodiment as shown in FIGS. 2-5 for preparation. Specifically, the preparation method of the novel antibacterial breathable fabric 700 in the embodiment adopts a flash spinning unit 100, a surface hot rolling unit 200 and a spunlaced consolidation units 300, and the spunlaced consolidation unit 300 adopts a combination of a drum 31 and three spunlace heads 32. Along the moving direction of the fiber mesh layer 600, the three spunlace heads 32 are the pre-wetting spunlace head 32, the main spunlace head 32 and the surface finishing spunlace head 32 in turn.

The finished products prepared in the embodiments and the comparative example were tested for relevant performance indexed, and test results are shown in Table 1 below.

TABLE 1

| Term | Gram weight of fiber web | Surface hot roll temperature, ° C. | Main spunlace pressure of spunlace head 32. bar | Gram weight of finished product g/m$^2$ | Thickness millimeter (mm) | Air permeability mm/s | Moisture permeability g/(m$^2$ · d) | Transverse breaking strength N/5 centimeters (cm) | Longitudinal breaking strength N/5 cm |
|---|---|---|---|---|---|---|---|---|---|
| Embodiment 1 | 65 | 140 | 80 | 65 | 0.23 | 19.8 | 10212 | 278 | 295 |
| Embodiment 2 | 40 | 135 | 60 | 40 | 0.15 | 32.8 | 13548 | 189 | 196 |
| Embodiment 3 | 90 | 145 | 100 | 90 | 0.34 | 10.4 | 6972 | 410 | 433 |
| Comparative example 1 | 65 | | | 65 | 0.22 | 13.5 | 7840 | 198 | 214 |

| Term | Gram weight of fiber web | Surface hot roll temperature | Main spunlace pressure of spunlace head 32 | Trans-tearing strength Newton (N) | Longitudinal tearing strength N | Peeling Strength N | Drape coefficient | Hydrostatic pressure of first side 71 K · Pa | Synthetic blood penetration resistance of first side 71 |
|---|---|---|---|---|---|---|---|---|---|
| Embodiment 3 | 65 | 140 | 80 | 26 | 25 | 3.5 | 23% | 13.4 | Grade 3 |
| Embodiment 2 | 40 | 135 | 60 | 19 | 20 | 3.1 | 19% | 9.8 | Grade 3 |
| Embodiment 3 | 90 | 145 | 100 | 35 | 37 | 3.4 | 28% | 15.6 | Grade 4 |
| Comparative example 1 | 65 | | | 21 | 18 | 2.8 | 35% | 11.2 | Grade 3 |

In Table 1, a drape degree refers to a degree to which a free boundary of the fabric sags under an action of its own weight. The degree is expressed by a drape coefficient F, which is a percentage of a ratio of a projected area of a drooping part of a sample to its original area. The smaller the percentage of drape coefficient F is, the better the drape degree of the fabric is, and the better the softness of the fabric is. The greater the grade of synthetic blood penetration resistance, the better.

In Table 1, a test standard or a method of each performance is: a gram weight test refers to a national standard GB/T24218.1-2009. A thickness test refers to a national standard GB/T24218.2-2009. An air permeability test refers to a national standard GB/T5453-1997. A moisture permeability test refers to a national standard GB/T12704-1991. A breaking strength test refers to GB/T24218.3-2010. A tearing strength test refers to a national standard GB/T3917.3-2009. A reference standard ASTM D2724 for peeling strength test. A hydrostatic pressure test refers to a national standard GB/T4744-1997. A synthetic blood penetration resistance test refers to a national standard GB19082-2009.

Figure 6:
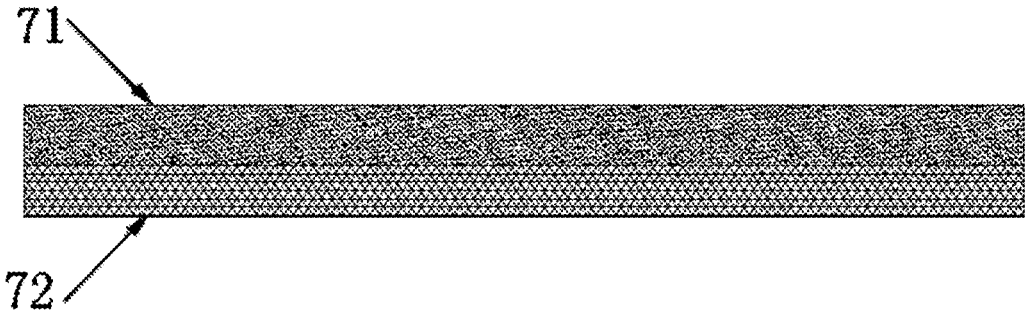
FIG. 6 is a structural schematic diagram of a novel antibacterial breathable fabric provided by the disclosure.

FIG. 6 is a structural schematic diagram of a novel antibacterial breathable fabric 700 made in this disclosure, which has a first side 71 and a second side 72. The finished fabric produced by this disclosure is formed by direct spinning by flash spinning, and is not compounded. The first side 71 and the second side 72 in Table 1 and FIG. 6 are only for showing that the both sides of the material have different characteristics. The first side 71 is an antibacterial surface (i.e., the upper surface referred to above), and the second side 72 is a spunlaced surface layer (i.e., the lower surface referred to above), i.e., the surface that contacts a body skin when in use.

Results of Analyzing Embodiments and Comparative Examples.

Figure 7:
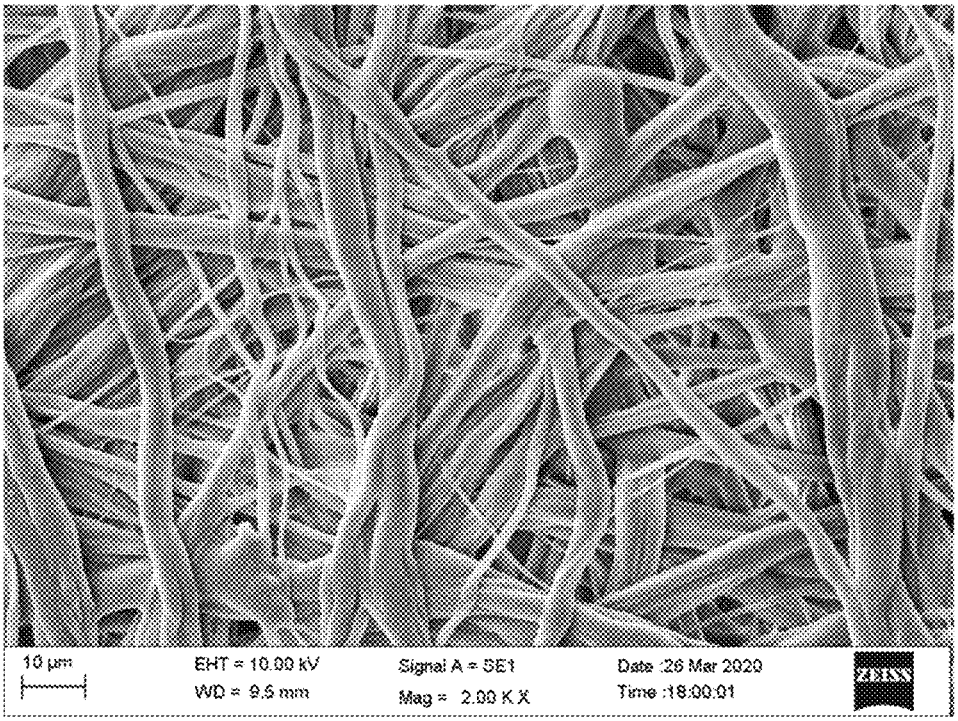
FIG. 7 is a fiber micrograph of a first side of a finished product of the novel antibacterial breathable fabric made in Embodiment 1 provided by the disclosure.
Figure 8:
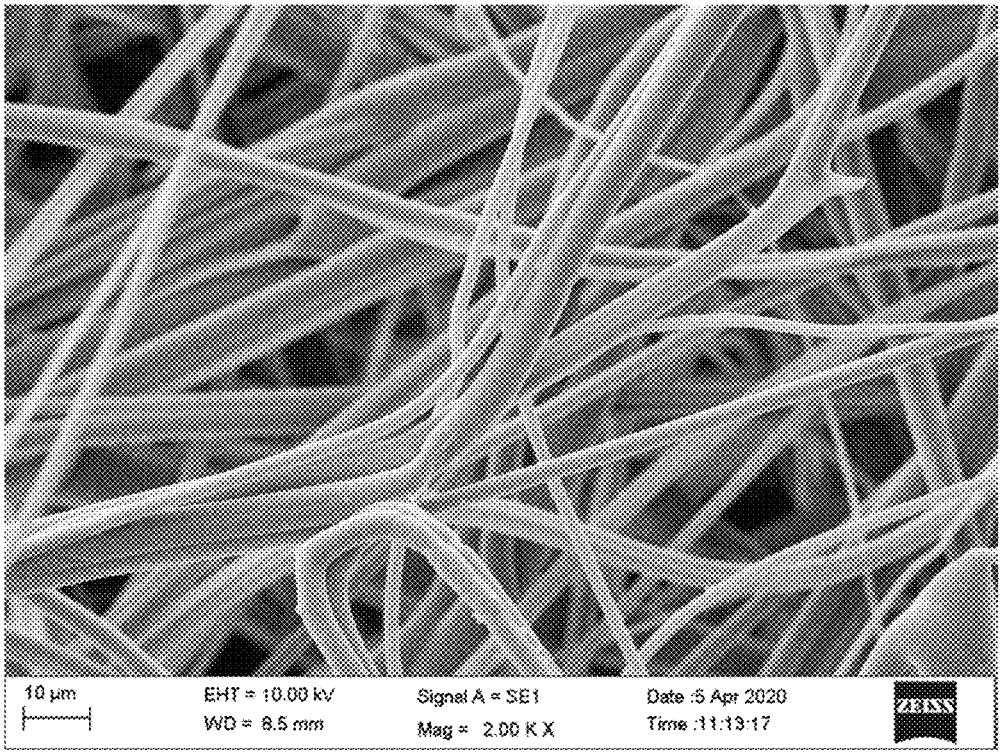
FIG. 8 is a fiber micrograph of a second side of the finished product of the novel antibacterial breathable fabric made in Embodiment 1 provided by the disclosure.

As may be seen from FIGS. 7-8, in the finished fabric made in Embodiment 1, a fiber micrograph of the first side 71 of the finished fabric in FIG. 7 shows that the surface fibers are fully bonded together, the surface is dense, and there are micropores between the fibers. The fiber micrograph of the second side 72 of the finished fabric in FIG. 8 shows that the surface fibers are not bonded and there are many micropores between the fibers. Meanwhile, combined with contents in Table 1, it may be seen that the antibacterial breathable fabrics prepared in embodiments 1-3 have good mechanical strength, good drape degrees, good softness and good breathability, which shows that the fabrics have good wearing comfort, and the fabrics may keep waterproof and antibacterial properties of the thermally bonded side, meeting use requirements of the fabrics. To sum up, the finished fabric has two characteristics: the finished product not only has high strength and high water resistance and antibacterial property of flash evaporation nonwovens, but also has excellent wearing comfort.

Through the preparation method according to the disclosure, one-time processing and molding of the nonwoven fabric finished product may be realized, and the finished product has two characteristics without using materials with different processes for compounding or bonding or adding additional softening treatment steps: the finished product has soft wearing comfort and excellent waterproof and antibacterial properties, while the mechanical strength of the material is kept good, so a service life of the material may be prolonged.

Compared with Embodiment 1, Comparative example 1 not only has a lower flexibility, but also has a lower use comfort of the finished product, and its air permeability, mechanical strength and water resistance are also obviously reduced, so it is difficult to have the same wearing comfort and excellent waterproof and antibacterial properties as the finished product prepared by the disclosure. Moreover, in Comparative example 1, there are many steps and complicated processes in the processing of finished fabrics.

To sum up, the disclosure has following beneficial effects.

Through the preparation method of the novel antibacterial breathable fabric 700 provided by the disclosure, one-time processing and molding of the finished product of the antibacterial breathable fabric may be realized, and the finished product may have two characteristics: excellent waterproof and antibacterial properties and good wearing comfort, while maintaining good mechanical properties to improve its service life and meet its use requirements without using materials with different processes for compounding or bonding, and without additional steps such as softening treatment.

The finished fabric prepared by this disclosure is formed by flash spinning and direct spinning, and is not compounded. Among them, the finished fabric has a first side 71 and a second side 72, the first side 71 is an antibacterial surface, and the second side 72 is a spunlaced surface (that is, the surface that contacts the body skin when in use). Moreover, the finished fabric may achieve following properties: its gram weight is 30-90 g, its thickness is 0.1 mm-0.5 mm, its air permeability is 5-50 mm/s, a moisture permeability is more than 2500 g/($m^2$·d), transverse and longitudinal breaking strengths are more than 150 N/5 cm, a tearing strength is more than 8 N (both a transverse tearing strength and a longitudinal tearing strength are more than 8 N), a peeling strength is greater than 3 N, and the drape coefficient is less than 50%. At the same time, a water seepage resistance of the first side 71 reaches 5-20 kilopascal (kPa), and synthetic blood penetration resistance is greater than grade 2.

It should be noted that:

in this paper, "gram weight" refers to a weight of material per unit area ($m^2$).

In this paper, "-" is used to represent a numerical range, which contains two endpoint values.

A polymer solute used in the spinning solution in embodiments and Comparative example is polyethylene. According to the above design concept, the polymer may adopt an existing polyolefin or a combination of various existing polyolefins, such as linear high-density polyethylene, linear polyethylene, low-density polyethylene, polypropylene and other conventional polymers used for preparing flash spinning, including but not limited to polyethylene provided in the embodiments.

At the same time, in actual control, technicians in this field adjust process parameters of surface hot rolling treatment and spunlace processing treatment according to gramage applicability of the fiber mesh layer 600 to ensure a performance of the finished product. Specifically, the specific process parameters are determined according to the material and the gram weight of the product. It is necessary to adjust the process parameters to achieve a desired product effect, such as the melting point of the material of the fiber mesh layer 600 and the small change in gram weight. If the melting point of the material is high, the hot rolling temperature of the surface hot rolling treatment should be increased accordingly to achieve a required thermal bonding effect. As the gram weight of the material of the fiber mesh layer 600 increases, number of fibers needing thermal bonding will increase, so it is necessary to increase the hot rolling temperature and the tension of the flexible belt 221 in the surface hot rolling treatment. As the gram weight of the material increases, the number of fibers that need to be entangled by spunlace will also increase, so it is necessary to increase a pressure of the main spunlace head 32.

In addition, it should be understood by those skilled in the art that although there are many problems in the prior art, each embodiment or technical scheme of the disclosure may be improved in only one or several aspects, and it is not necessary to solve all the technical problems listed in the prior art or the background art at the same time. Those skilled in the art should understand that what is not mentioned in a claim should not be taken as a limitation of the claim.

Although many terms such as surface hot rolling treatment, spunlace processing treatment and cold pressing treatment are used in this paper, a possibility of using other terms is not excluded. These terms are only used to describe and explain an essence of this disclosure more conveniently. It is against a spirit of this disclosure to interpret them as any additional restrictions. The terms "first", "second" and so on (if any) in the description and claims of the embodiments of the disclosure and the above drawings are used to distinguish similar objects, and are not necessarily used to describe a specific order or sequence.

Finally, it should be explained that the above embodiments are only used to illustrate the technical scheme of the disclosure, but not to limit it. Although the disclosure has been described in detail with reference to the foregoing embodiments, it should be understood by those skilled in the art that the technical scheme described in the foregoing embodiments may still be modified, or some or all of its technical features may be replaced by equivalents. However, these modifications or substitutions do not make an essence of corresponding technical schemes deviate from a scope of the technical schemes of various embodiments of this disclosure.

In addition, it should be understood by those skilled in the art that although there are many problems in the prior art, each embodiment or technical scheme of the disclosure may be improved in only one or several aspects, and it is not necessary to solve all the technical problems listed in the prior art or the background art at the same time. Those skilled in the art should understand that what is not mentioned in a claim should not be taken as a limitation of the claim.

What is claimed is:

1. A preparation method of a novel antibacterial breathable fabric, comprising following steps:

preparation of a fiber mesh layer: preparing a spinning solution with a high polymer as a raw material, and forming the fiber mesh layer from the spinning solution by a flash spinning method;

cold pressing treatment: performing the cold pressing treatment to the fiber mesh layer before a surface hot rolling treatment; and the surface hot rolling treatment: performing the surface hot rolling treatment to the fiber mesh layer to prepare the fiber mesh layer with fibers on an upper surface thermally bonded and fibers on a lower surface fluffy;

wherein a surface hot rolling unit is adopted to perform the surface hot rolling treatment on the fiber mesh layer; the surface hot rolling unit comprises a conveyor belt member and a rotary heating member;

the conveyor belt member comprises a flexible belt and at least two support members; the support members are rotatably supported on an inner surface of the flexible belt; an outer surface of the flexible belt is in contact with an outer periphery of the rotary heating member;

the flexible belt has a closed annular structure, and rotation of the rotary heating member drive the flexible belt to rotate around an outer periphery of the support members in an annular manner, so that after the fiber mesh layer is introduced into the outer surface of the flexible belt, the lower surface contacts with the flexible belt, and the upper surface is brought into the outer periphery of the rotary heating member for the surface hot rolling treatment, wherein the flexible belt is made of a high-temperature resistant flexible material;

spunlace processing treatment: performing the spunlace processing treatment on the lower surface of the fiber mesh layer prepared by the surface hot rolling treatment; and drying step: drying a nonwoven fabric after the spunlace processing treatment to remove moisture on the nonwoven fabric, thus obtaining the novel antibacterial breathable fabric.

2. The preparation method of the novel antibacterial breathable fabric according to claim 1, wherein in the drying step, a drying temperature is less than a melting point of the fiber mesh layer.

3. The preparation method of the novel antibacterial breathable fabric according to claim 1, wherein the flexible belt is made of a high-temperature resistant blanket.

* * * * *